United States Patent [19]

Badger

[11] Patent Number: 4,717,626

[45] Date of Patent: Jan. 5, 1988

[54] TROPHY MOUNT

[76] Inventor: Gary W. Badger, R.D. #1, Box 381-A, Lewisburg, Pa. 17837

[21] Appl. No.: 2,508

[22] Filed: Jan. 12, 1987

[51] Int. Cl.[4] ..... B44C 5/02

[52] U.S. Cl. ..... 428/542.4; 428/16; 428/913.3; 434/296

[58] Field of Search ..... 428/542.4, 16, 913.3; 434/296

[56] References Cited

U.S. PATENT DOCUMENTS

| | | | |
|---|---|---|---|
| 453,008 | 5/1891 | Kaempfer | 428/542.4 X |
| 2,003,896 | 6/1935 | Menger | 434/296 |
| 2,831,271 | 4/1958 | Stitt | 434/296 |
| 2,851,806 | 9/1958 | Moravec, Jr. | 428/913.3 X |
| 2,992,494 | 7/1961 | Jonas | 434/296 |
| 3,301,728 | 1/1967 | Swartz | 156/220 |
| 3,319,922 | 5/1967 | Christensen | 428/913.3 X |
| 4,464,440 | 8/1984 | Dotzman | 428/542.4 |

*Primary Examiner*—Henry F. Epstein
*Attorney, Agent, or Firm*—Thomas Hooker

[57] ABSTRACT

A trophy mount includes a base completely surrounding a bone bridge joining a pair of antlers or horns. The base is mounted on a support plaque.

6 Claims, 9 Drawing Figures

TROPHY MOUNT

Figure 1:
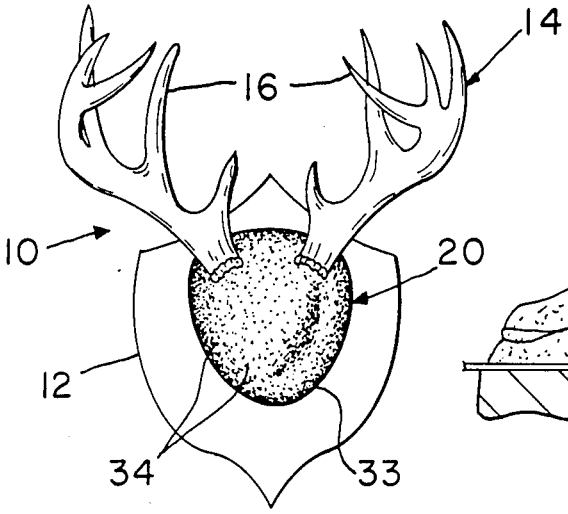
Figure 2:
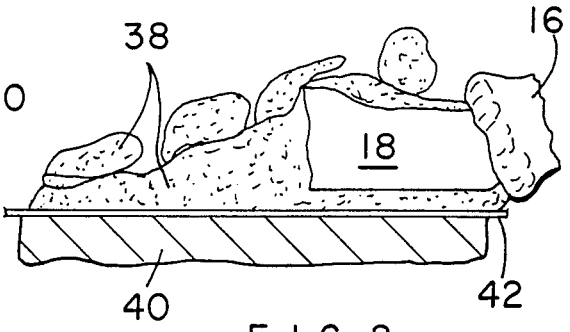

The invention relates to an improved trophy mount for displaying a pair of animal antlers and includes an individually molded and hard base surrounding a bone bridge extending between the individual antlers and a plaque supporting the base for appropriate display of the antlers. The base is provided with an attractive sand-coated exterior surface. It is joined to the plaque by a screw extending through the plaque and engaging a threaded insert imbedded within the base.

Conventional trophy mounts are disclosed in U.S. Pat. Nos. 453,008, 2,003,896, 3,319,922 and 4,464,440. The first three of the prior art patents disclose the mounts for antlers with a bridge between separate horns. The relatively unsightly bridge is covered by a preformed member. These mounts are unable to smoothly and attractively receive and cover antlers of varying width.

The present invention accommodates all sizes and shapes of horned trophies thereby permitting forming of an attractive trophy mount with a base closely surrounding the bridge and extending to the base of the antlers to closely simulate the skull while permitting ready mounting of the base and antlers on a supporting plaque. The trophy mount may be easily made by a hunter or a sportsman to the requirements of a particular trophy.

Other objects and features of the invention will become apparent as the description proceeds, especially when taken in conjunction with the accompanying drawings illustrating the invention, of which there are two sheets and one embodiment.

IN THE DRAWINGS

FIG. 1 is a perspective view of a trophy mount according to the invention; and FIGS. 2 through 9 illustrate the steps of making a trophy mount according to the invention.

Mount 10 includes a flat wooden plaque 12 supporting a pair of trophy antlers 14 for display. The antlers project forwardly and upwardly from the plaque. The two individual antlers or racks 16 are joined together by a portion of skull bone or bridge 18 shown in FIGS. 2 through 8. The bridge is completely embedded within a hardened, formed base 20 having a flat mounting surface 22 facing away toward the plaque. A metal fastener 24 is embedded within the base below the bridge. Threaded bore 26 extends into the base through surface 22 to guide mounting screw 28 into threaded engagement with the fastener. An adjustable hanger 30 is mounted on the rear surface of the plaque to facilitate mounting the trophy on the vertical wall.

The outer surface 32 of base 20 is convex in shape and joins the mounting surface at peripheral edge 33 extending around the body. The body extends below the bridge a distance sufficient to receive the fastener 24 and facilitate the smooth blending of surface 32 toward the edge and mounting of the plaque so that the base 20 simulates in appearance the rounded forehead of the animal from which the trophy horns were taken. The surface 32 is provided with a layer of colored granules of a color the same or similar to the color of fur from which the trophy antlers were taken, thereby further improving the appearance of the base. Trophy mount 10 is shown supporting a pair of deer antlers. In this case the granules 34 may be light brown grains of sand. Screw 28 and glue hold the base to plaque 12.

The mount 10 is made by first removing the antlers 14 from the trophy skull. This is done by carefully sawing through the skull bone to form the continuous bridge 18. Preferably the bridge is removed using a pair of 90 degree cuts so that the bridge side 36 lies essentially in a vertical plane when the antlers are in the proper displayed position as shown in FIG. 1. After the antlers have been removed from the skull, the skin and surrounding organic matter are removed. The antlers and bridge are then allowed to air-dry completely.

Base 20 is formed from a commercially available moldable epoxy putty material 38. The base is made by placing a body of the material 38 on a support surface 40 preferably covered by a sheet of protective waxed paper 42. A thin layer of putty is applied following which the antlers are placed on the work surface with the bridge surface 36 resting on the previously appllied thin layer of putty material. Additional putty is then applied to the surface and around the entirety of the bridge to form a domed base as illustrated. When completed, the base completely surrounds the bridge 18 and is generally symmetrical about a plane perpendicular to the support surface located midway between the two horns 16. See FIG. 1. The base is made up by addng small amounts of putty and smoothing the base to achieve the desired convex and symmetrical shape. During formation of the base, the horns 16 are supported to maintain proper orientation of the bridge with surface 36 on parallel to the surface of support 40.

Figure 3:
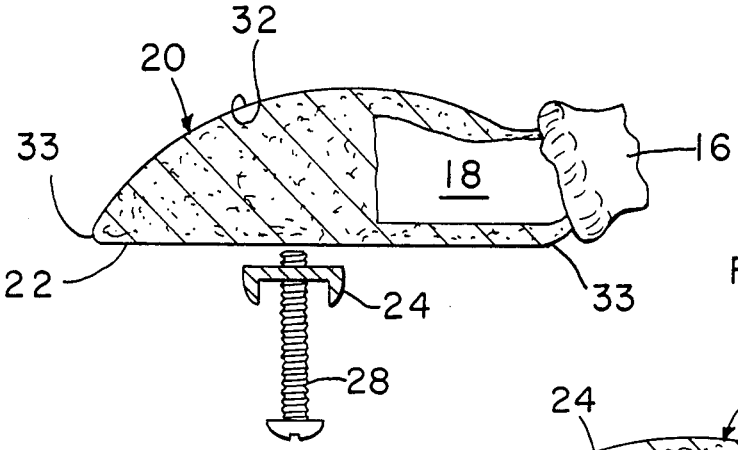
Figure 4:
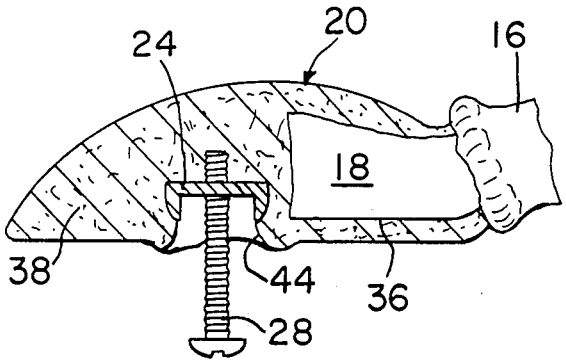
Figure 5:
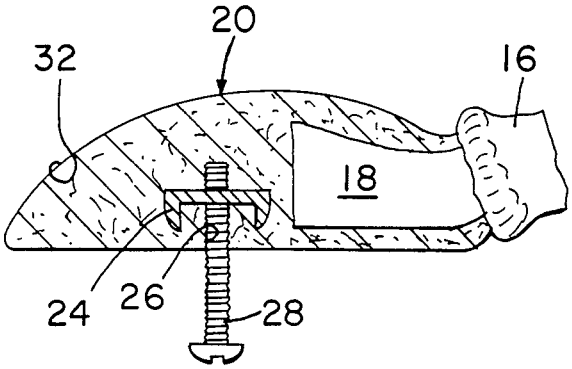
Figure 6:
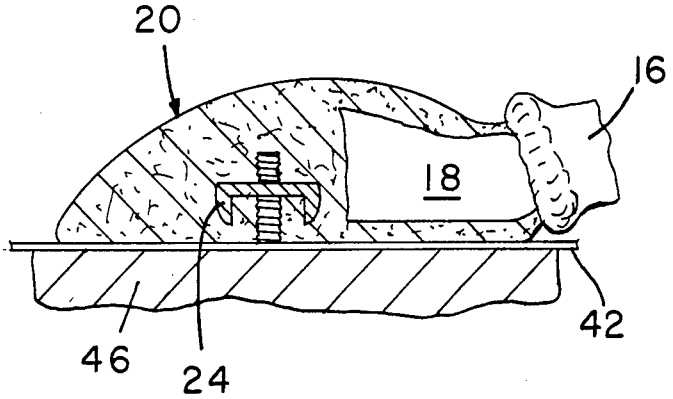
Figure 7:
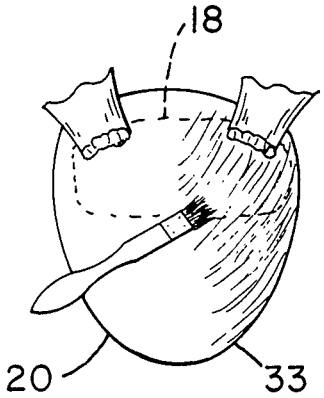
Figure 8:
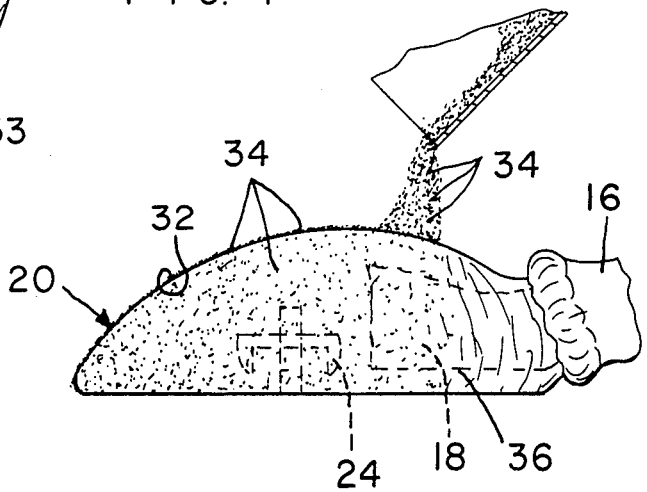
Figure 9:
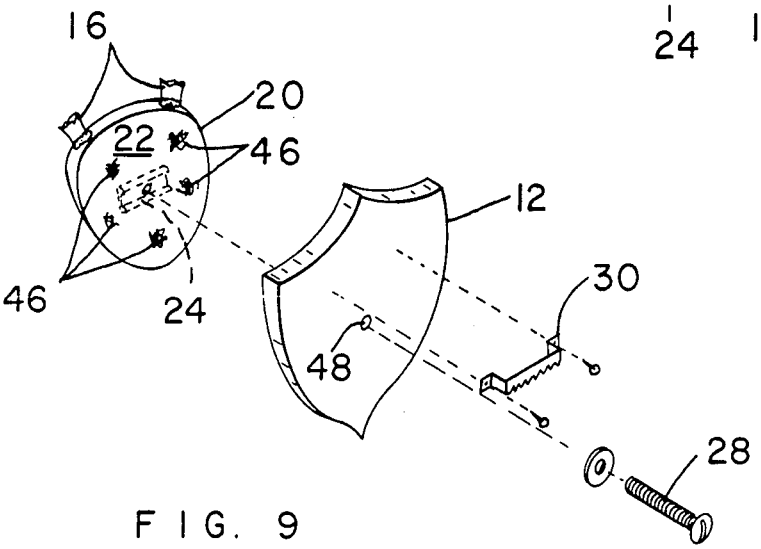

After the base has been molded the exterior surface 32 is carefully smoothed to remove air pockets and clay seams. The base and antler assembly are then removed from support 40 to permit insertion of fastener 24 as shown in FIGS. 3 and 4. The fastener 24 is threaded a short distance onto the free end of the screw 28. While holding the screw in one hand and the base in the other hand the screw and fastener are pushed through surface 32 and into the plastic base to seat the fastener a distance inwardly of surface 22 as shown in FIG. 4. Seating of the fastener within the base forms a recess 44 in surface 22. This recess is then filled by smoothing in the displaced putty as in FIG. 5 so that the fastener is completely embedded within the base, putty material closely surrounds the end of screw 28, and the surface 22 is restored beneath the fastener. Screw 28 is then rotated and unthreaded from fastener and the surrounding putty while retaining molded threads in the putty.

Following molding the base about the bridge and insertion of the fastener, the antlers and base are placed on a flat support surface with suitable additional support to hold the antlers in the proper location and the support, base and antlers are placed in an oven to harden the epoxy putty forming the base. Conventional epoxy putty may be hardened by baking for 30 to 45 minutes in an oven at approximately 275° F. After baking the hardened base and antlers are removed from the oven and allowed to cool to room temperature. In the event the cooled base contains imperfections additional putty may be applied and hardened by rebaking as before. Surface 22 may be filed as required to assure flush mounting on plaque 12.

Surface 32 may be sanded to a desired smoothness. Following wiping off of the sanding dust a generous but even layer of glue is applied to the surface. See FIG. 7. Glue is not applied to the antlers projecting from the base. Following application of the glue an even coasting of colored granules 34 is dusted on the surface so that the surface assumes the color of the granules. After drying of the glue a second coat of glue may be applied on the surface following which a second coat of granules may be applied. After drying of the final application of glue and granules, loose granules are dislodged from the base. Granular surface 32 has a rough appearance simulating the fur of the animal carrying the horns 14. The granules may be appropriately colored sand.

The completed base is mounted on plaque 12 by applying drops of glue 36 to surface 22 at locations surrounding the embedded fastener 24 and then moving screw 28 located on the back of the plaque 12 through bore 48 extending through the plaque. The lead end of the screw is threaded into threaded bore 26 formed in the base and fastener 24 so that tightening the screw engages the fastener 24 and secures the base flush against the front surface of the plaque. The thickness of the plaque prevent the screw from bottoming in bore 26. During mounting of the base on the plaque the screw is first loosely tightened against the base and the base is properly oriented on the plaque so that the antler horns are located symmetrically to either side of the plaque as shown. Preferably, the plaque is symmetrical to either side of the plane extending through the center of the base between the antlers and perpendicular to the surface 22 to provide a neat and attractive trophy mount as shown in FIG. 1.

Hanger 30 is secured to the back of the plaque to facilitate hanging of the plaque on a wall.

While I have illustrated and described a preferred embodiment of my invention, it is understood that this is capable of modification, and I therefore do not wish to be limited to the precise details set forth, but desire to avail myself of such changes and alterations as fall within the purview of the following claims. For instance the invention may be used to mount various types of paired antlers or horns.

What I claim as my invention is:

1. A trophy mount for the display of a pair of animal antlers comprising:

(a) A pair of spaced apart animal antlers and an integral portion of skull bone forming a bridge joining the horns together;

(b) A hardened base having i. A flat base-mounting surface, and ii. A smoothly convexly shaped outer surface, said surfaces joining each other at a peripheral edge extending around the base, (c) Said bridge being embedded within said base between the surfaces so that the bridge is completely surrounded by the base and the horns project outwardly through the outer base surface, (d) Plaque fastening means embedded within the base adjacent to the communicating with the base mounting surface and below of the bridge, (e) A plaque having a flat exterior plaque mounting surface, and (f) Mounting means engageable with the plaque and the fastening means to secure base to the plaque with the base and plaque mounting surfaces in flush engagement.

2. A trophy mount as in claim 1 including bonding means joining said mounting surfaces together.

3. A trophy mount as in claim 1 including a layer of colored granules adhered to the base outer surface whereby the body simulates animal fur.

4. A trophy mount as in claim 1 wherein said antlers are spaced apart and the base is generally symmetrical about a plane perpendicular to said mounting surface located midway between the antlers.

5. A trophy mount as in claim 1 wherein said fastening means includes a metal member having a first threads and said base includes second threads opening through said base mounting surface and continuous with said first threads, and said mounting means comprises a threaded member engagable with the plaque and both said threads.

6. A trophy mount as in claim 1 wherein said bridge includes a surface adjacent and generally parallel to the base mounting surface.

* * * * *